US010926322B2

(12) United States Patent
Steiner

(10) Patent No.: US 10,926,322 B2
(45) Date of Patent: Feb. 23, 2021

(54) DIE CASTING MACHINE WITH A DIE CASTING MOLD FOR PRODUCING METAL DIE CAST PARTS, AND OPERATING METHOD

(71) Applicant: Bayerische Motoren Werke Aktiengesellschaft, Munich (DE)

(72) Inventor: Thomas Steiner, Mauern (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/837,184

(22) Filed: Apr. 1, 2020

(65) Prior Publication Data

US 2020/0222977 A1 Jul. 16, 2020

Related U.S. Application Data

(63) Continuation of application No. PCT/EP2018/075939, filed on Sep. 25, 2018.

(30) Foreign Application Priority Data

Nov. 15, 2017 (DE) ..... 10 2017 220 315.3

(51) Int. Cl.
*B22D 17/22* (2006.01)
*B22D 17/32* (2006.01)

(52) U.S. Cl.
CPC ..... *B22D 17/32* (2013.01); *B22D 17/22* (2013.01); *B22D 17/2218* (2013.01)

(58) Field of Classification Search
CPC ..... B22D 17/2218; B22D 17/22; B29C 45/73
See application file for complete search history.

(56) References Cited

U.S. PATENT DOCUMENTS 3,356,131 A * 12/1967 Smith ..... B22D 17/2218 164/314
4,439,492 A * 3/1984 Wada ..... B29C 33/06 264/403

(Continued)

FOREIGN PATENT DOCUMENTS

DE 37 04 913 A1 8/1988
DE 37 12 128 C2 10/1989

(Continued)

OTHER PUBLICATIONS

International Search Report (PCT/ISA/210) issued in PCT Application No. PCT/EP2018/075939 dated Nov. 30, 2018 with English translation (five (5) pages).

(Continued)

*Primary Examiner* — Kevin E Yoon
(74) *Attorney, Agent, or Firm* — Crowell & Moring LLP

(57) ABSTRACT

A die casting machine with a die casting mold produces metal die cast parts. The die casting machine has a first machine shield, to which a first mold half of the die casting mold is secured, and a second machine shield, to which a second mold half of the die casting mold is secured. In order to compensate for the deflection of the machine shields, an intermediate plate which has at least two temperature-controlling devices that can be used to generate a temperature difference leading to the curving of the intermediate plate is arranged between the first machine shield and the first mold half and/or between the second machine shield and the second mold half.

11 Claims, 1 Drawing Sheet

(56) References Cited

U.S. PATENT DOCUMENTS

| | | | | |
|---|---|---|---|---|
| 5,062,786 | A * | 11/1991 | Arai | B29C 45/78 425/174 |
| 2007/0039943 | A1 | 2/2007 | Burr et al. | |
| 2010/0176523 | A1 * | 7/2010 | Sekihara | B29C 45/78 264/2.7 |

FOREIGN PATENT DOCUMENTS

| | | | |
|---|---|---|---|
| DE | 297 24 134 | U1 | 4/2000 |
| DE | 103 37 685 | B4 | 2/2008 |
| DE | 10 2009 033 123 | B3 | 9/2010 |
| DE | 10 2012 024 051 | A1 | 6/2014 |
| DE | 10 2016 123 495 | A1 | 6/2018 |
| DE | 10 2016 123 496 | A1 | 6/2018 |

OTHER PUBLICATIONS

German-language Written Opinion (PCT/ISA/237) issued in PCT Application No. PCT/EP2018/075939 dated Nov. 30, 2018 (five (5) pages).

German-language Office Action issued in German Application No. 10 2017 220 315.3 dated Jul. 10, 2018 (five (5) pages).

* cited by examiner

DIE CASTING MACHINE WITH A DIE CASTING MOLD FOR PRODUCING METAL DIE CAST PARTS, AND OPERATING METHOD

CROSS REFERENCE TO RELATED APPLICATIONS

This application is a continuation of PCT International Application No. PCT/EP2018/075939, filed Sep. 25, 2018, which claims priority under 35 U.S.C. § 119 from German Patent Application No. 10 2017 220 315.3, filed Nov. 15, 2017, the entire disclosures of which are herein expressly incorporated by reference.

BACKGROUND AND SUMMARY OF THE INVENTION

The invention relates to a die casting machine with a die casting mold for producing metal die cast parts, wherein the die casting machine comprises a first machine shield, to which a first mold half of the die casting mold is fastened, and a second machine shield, to which a second mold half of the die casting mold is fastened.

The invention additionally relates to a method for operating such a die casting machine with a die casting mold.

DE 10 2009 033 123 B3 describes a die casting machine with a die casting mold. The die casting machine comprises a fixed machine shield and a movable machine shield. A fixed mold half is fastened to the fixed machine shield. A movable mold half is connected to the movable machine shield. The mold halves together form a die casting mold and delimit a cavity. A cast metal part can be produced by filling the cavity with flowable metal.

In spite of their solid design, the machine shields can be deformed as a result of the high closing forces of up to several thousand tons which are necessary, in particular, in the case of larger die cast parts. The mold halves, as a result of said deformation behavior of the machine shields, are not pressed or clamped together in an optimum manner, in particular centrally, but they yield rather (so-called deflection). On the one hand, this affects the quality of the cast part as, for example, the ideal casting pressure cannot be obtained, and, on the other hand, a high level of wear is generated on the sealing surfaces. Attempts have been made to date to compensate for the deformation behavior of the machine shields by putting plates underneath the mold halves manually, which is, however, very time-consuming.

The object underlying the invention is to provide a die casting machine with a die casting mold which does not have at least one disadvantage which accompanies the prior art or at least only has it in a diminished manner.

The object is achieved by the die casting machine with a die casting mold according to the claimed invention. The invention also extends to the preferred use of the die casting machine according to the claimed invention. The invention additionally extends to a method for operating a die casting machine according to the claimed invention or to an operating method for a die casting machine according to the claimed invention.

According to the invention, an intermediate plate, which comprises at least two temperature-controlling devices by way of which a temperature difference which results in curvature (of the intermediate plate) or in plate curvature is generatable, is arranged between the first machine shield and the first mold half and/or between the second machine shield and the second mold half. That is, the intermediate plate comprises two or more temperature-controlling devices, by way of which a temperature difference or a temperature delta which results in curvature of the intermediate plate, can be generated (inside the intermediate plate).

By way of the temperature-controlling devices in the intermediate plate, a curved deformation or curvature of the intermediate plate can be produced in a targeted manner in the direction of the mold half, as a result of which the deformation behavior, in particular a deflection, of the machine shield can be compensated for by the curvature pressing, in particular centrally, against the mold half. The curvature is in the opposite direction to the deformation (deflection) of the machine shield. As a result of the curvature, pressure is able to be applied, in particular centrally (i.e. center of the machine shield or center of the mold half) to the mold half, which has been accomplished up to now by putting plates underneath the mold halves (see above). The effect obtained with the intermediate plate is able to be adjusted without any manual measures just by modifying the temperature difference inside the intermediate plate.

As a result, larger die cast shapes, above all, are also pressed together in an ideal manner, in particular centrally, and optimum casting pressures can be worked with without the die casting mold leaking. The die cast parts produced comprise a high degree of quality overall with regard to dimensional stability and porosity. In addition, the tool sealing surfaces are protected. Moreover, expenditure on tool changing and overhauling is reduced.

The intermediate plate can comprise a first temperature-controlling device which is electrically operable, and a second temperature-controlling device which is operable with a temperature-controlling medium (for example oil or water). In a preferred manner, however, it is provided that both the first temperature-controlling device and the second temperature-controlling device are operable with a temperature-controlling medium, wherein it is provided, in particular, that the temperature-controlling devices are formed by differently designed duct systems which differ, for example in number and/or course, from flow channels.

The intermediate plate can be produced from a solid (monolithic) steel block. The intermediate plate can comprise a height of between 250 mm and 350 mm, in a preferred manner of approximately 300 mm, in the direction of closing or travel of the die casting machine.

The die casting machine according to the invention is used in a preferred manner for producing motor vehicle components (motor vehicle cast components) and is used, in particular, for producing motor vehicle side members (cast side members) which, for example, comprise a length of between 1300 mm and 1700 mm. The die casting mold is realized in a corresponding manner. In a preferred manner, these are aluminum die cast parts.

The method according to the invention for operating a die casting machine according to the invention provides setting the temperature difference in the intermediate plate by use of the temperature-controlling devices such that the casting mold halves of the die casting mold close in an ideal manner. This means, in particular, that the mold halves are pressed together or clamped together sufficiently when the die casting mold is closed (i.e. as provided in the case of the design of the casting mold) and/or that a provided minimum sealing pressure is achieved around the sealing surfaces of the mold halves when the die casting mold is closed. In a preferred manner, it is provided that a temperature difference of between 30 K and 70 K, in a particularly preferred manner of between 40 K and 60 K, and in particular of approximately 50 K is set. A suitable temperature difference and suitable temperature values for the temperature-controlling devices are able to be determined as a result of simulation and/or tests.

The invention is explained in more detail below by way of the drawing. The features shown in the figures of the drawing and/or explained below can be general features of the invention, even independently of specific combinations of features, and can develop the invention further in a corresponding manner.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
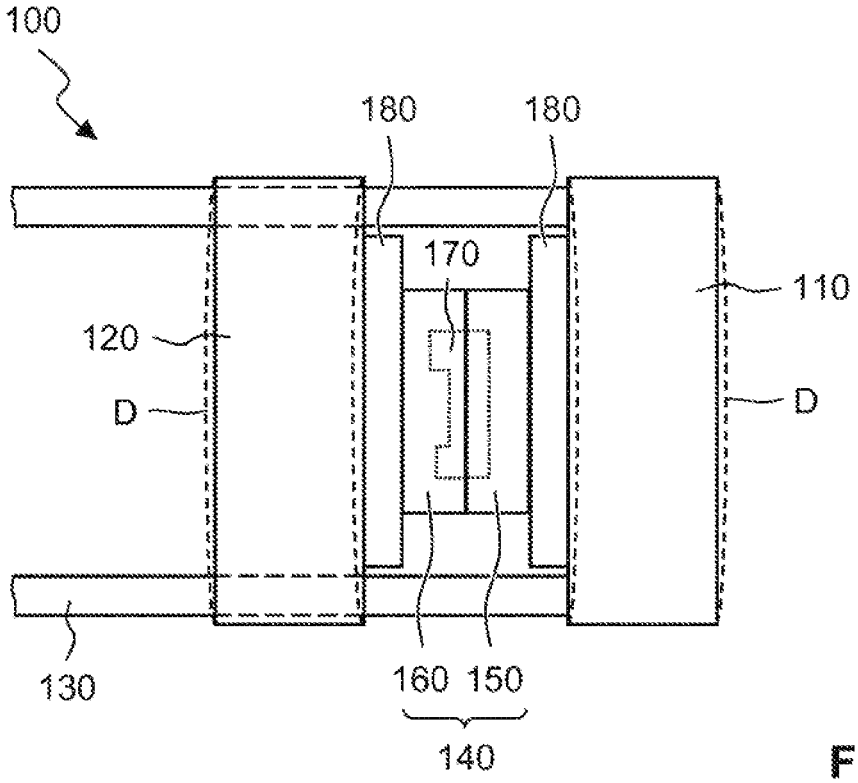
FIG. 1 is a schematic representation of a die casting machine according to an embodiment of the invention with a die casting mold.

The die casting machine 100 shown in FIG. 1 comprises a first machine shield 110 and a second machine shield 120. The second machine shield 120 is guided on guides 130 so as to be horizontally movable. A first mold half 150 of the die casting mold 140 is fastened to the first machine shield 110. A second mold half 160 of the die casting mold 140 is fastened to the second machine shield 120. Platens or the like for the mold halves 150, 160 are not shown. The vertically divided mold halves 150, 160 delimit a cavity 170 for producing a die cast part of metal or a metal die cast part.

An intermediate plate 180 is arranged in each case between the first machine shield 110 and the first mold half 150 and between the second machine shield 120 and the second mold half 160. The intermediate plates 180 compensate for the deflections D, shown by the dotted lines, of the machine shields 110, 120, as is shown in more detail below. The intermediate plates 180 are fastened in a suitable manner to the machine shields 110, 120, in particular only in their edge regions. The mold halves 150, 160 can be fastened to the intermediate plates 180 and/or the intermediate plates 180 can be fastened via—or reaching through—the machine shields 110, 120. The intermediate plates 180 can be realized in an identical or also a different manner.

The die casting machine 100 can include further components which are known from the prior art, such as, for example, a machine bed, a machine control unit, a shot unit for introducing the molten mass into the cavity 170, a closing drive for driving the movable machine shield 120, an ejecting device and the like.

Figure 2:
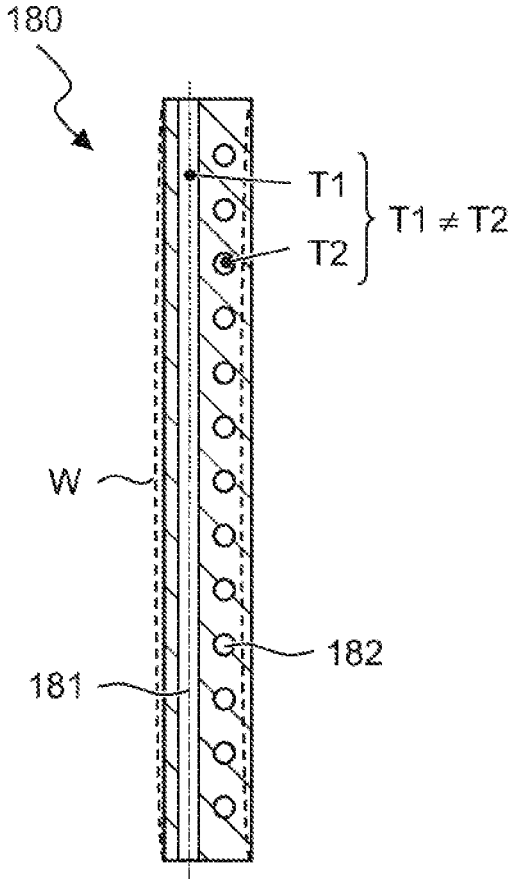
FIG. 2 illustrates a schematic representation of the function of an exemplary intermediate plate in the die casting machine of FIG. 1.

FIG. 2 shows a sectional representation of one of the intermediate plates 180. The intermediate plate 180 comprises a first and a second temperature-controlling device, by way of which a temperature difference, which leads to the defined plate curvature W, can be generated inside the intermediate plate 180. To this end, the intermediate plate 180 is realized with a first duct system 181 and with a second duct system 182 which both differ in number and course from its flow channels. The temperature-controlling devices or duct systems 181, 182 can be operated by a temperature-controlling medium which is provided, for example, on the machine side.

The temperature-controlling medium for the first duct system 181 comprises the temperature T1 (for example 100° C.) and the temperature-controlling medium for the second duct system 182 comprises the temperature T2 (for example 50° C.). A curvature W of the intermediate plate 180 is achieved in a bi-metalloid manner as a result of the temperature difference provided (for example 50 K), as shown by the dotted line. The central curvature is, for example, between 1.0 mm and 2.0 mm. Pressure can be applied to the given mold half 150 or 160, in particular centrally, by way of the curvature W. That is, in FIG. 1 the curvature of the left-hand intermediate plate 180 is effected to the right so that it presses against the second mold half 160, and the curvature of the right-hand intermediate plate 180 is effected to the left so that it presses against the first mold half 150. The curvature W and the pressure achievable thereby can be set by way of the temperature difference (T1–T2).

LIST OF REFERENCES

100 Die casting machine
110 Machine shield
120 Machine shield
130 Guide
140 Die casting mold
150 Mold half
160 Mold half
170 Cavity
180 Intermediate plate
181 Temperature-controlling device
182 Temperature-controlling device
D Deflection
T1 Temperature
T2 Temperature
Curvature (plate curvature)

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A die casting machine with a die casting mold for producing metal die cast parts, comprising:

a first machine shield, to which a first mold half of the die casting mold is fastened;

a second machine shield, to which a second mold half of the die casting mold is fastened; and an intermediate plate, which comprises at least two temperature-controlling devices by way of which a temperature difference which results in curvature is generatable, wherein the intermediate plate is arranged between the first machine shield and the first mold half and/or between the second machine shield and the second mold half.

2. The die casting machine according to claim 1, wherein the intermediate plate comprises a first, electrically operable temperature-controlling device and a second temperature-controlling device which is operable with a temperature-controlling medium.

3. The die casting machine according to claim 1, wherein the intermediate plate comprises a first temperature-controlling device which is operable with a temperature-controlling medium and a second temperature-controlling device which is operable with a temperature-controlling medium.

4. The die casting machine according to claim 3, wherein the two temperature-controlling devices are formed by two differently designed duct systems.

5. The die casting machine according to claim 1, wherein the intermediate plate is produced from a solid steel block.

6. The die casting machine according to claim 1, wherein the intermediate plate comprises a height of between 250 mm and 350 mm in a closing direction.

7. A method of using a die casting machine having a die casting mold, the die casting machine comprising:

a first machine shield, to which a first mold half of the die casting mold is fastened;

a second machine shield, to which a second mold half of the die casting mold is fastened; and an intermediate plate, which comprises at least two temperature-controlling devices by way of which a temperature difference which results in curvature is generatable, wherein the method comprises:

arranging the intermediate plate between the first machine shield and the first mold half and/or between the second machine shield and the second mold half; and producing motor vehicle components via the die casting machine with the intermediate plate.

8. The method according to claim 7, wherein the produced motor vehicle components are motor vehicle side members.

9. A method of operating a die casting machine comprising a first machine shield, to which a first mold half of the die casting mold is fastened; a second machine shield, to which a second mold half of the die casting mold is fastened; and an intermediate plate, which comprises at least two temperature-controlling devices by way of which a temperature difference which results in curvature is generatable, the method comprising:

arranging the intermediate plate between the first machine shield and the first mold half and/or between the second machine shield and the second mold half;

setting a temperature difference in the intermediate plate such that the first and second mold halves of the die casting mold properly close.

10. The method according to claim 9, wherein the temperature difference is set to be between 30 K and 70 K.

11. The method according to claim 9, wherein the temperature difference is set to be 50 K.

* * * * *